US008398919B2

(12) United States Patent
Lajunen

(10) Patent No.: US 8,398,919 B2
(45) Date of Patent: Mar. 19, 2013

(54) METHOD FOR REPAIRING EXTERIOR WALL STRUCTURES

(75) Inventor: Raimo Lajunen, Timola (FI)

(73) Assignee: Microbe Control Finland Oy, Helsinki (FI)

( * ) Notice: Subject to any disclaimer, the term of this patent is extended or adjusted under 35 U.S.C. 154(b) by 383 days.

(21) Appl. No.: 12/802,359

(22) Filed: Jun. 4, 2010

(65) Prior Publication Data

US 2011/0296790 A1 Dec. 8, 2011

(51) Int. Cl.
*A61L 9/00* (2006.01)
*F24F 7/00* (2006.01)
*F24F 7/007* (2006.01)

(52) U.S. Cl. ..... 422/32; 422/31; 454/185; 454/186

(58) Field of Classification Search ..... 422/31–32; 454/185–186

See application file for complete search history.

(56) References Cited

U.S. PATENT DOCUMENTS 5,155,924 A * 10/1992 Smith ..... 34/443
2004/0067178 A1 4/2004 Molleker ..... 422/186.07

FOREIGN PATENT DOCUMENTS

DE 42 40 378 A1 6/1994
DE 197 21 795 A1 11/1998
DE 10 2006 034 745 A1 1/2008

OTHER PUBLICATIONS

Translation of Virpi Leivo, "Guidebook to Moisture Problems" Tampere University Journal (1998) article.*
Translation of Jukka Landensivu "Juko—Instruction Folder for Going Through a Facade Renovation" Tampere University Journal (2006) article.*
"Opas Kosteusongelmiin—Rakennustekninen, Mikrobiologinen ja laaketieteellinen nakokulma", Toimittanut Virpi Leivo, Julkaisu 95 Talonrakennusteknikka, Rakennustekniikan osasto 1998, pp. 116-119.
"Moisture damages in an accident at the right time and save money", Sarjo Annina, Suomen Kiinteistolehti, Jul. 2006, 1 pg.
"Juko—Ohjeistokansio Julkisivukorjaushankkeen Lapiviemiseksi", Tampereen Teknillinen Yliopisto, Aug. 2006, 22 pgs.

* cited by examiner

*Primary Examiner* — Walter D Griffin
*Assistant Examiner* — Christopher Vandeusen
(74) *Attorney, Agent, or Firm* — Harrington & Smith

(57) ABSTRACT

The invention relates to a method for repairing exterior wall structures. According to the invention, the transfer of moisture through external cladding to the wall structure is prevented by treating the external cladding with facade protection, after which holes are formed in the external cladding at a distance from each other and, through the holes, an insulation space behind the external cladding is dried and disinfected with disinfectant.

3 Claims, No Drawings

METHOD FOR REPAIRING EXTERIOR WALL STRUCTURES

FIELD OF INVENTION

The invention relates to a method for repairing the exterior wall structures of a building.

BACKGROUND

Constructing exterior wall structures made of stone material of buildings without a ventilation gap, the so-called ventilation slot, has been the industry custom for decades, at least in the Nordic countries. Exterior structures of stone material are masonry, plastered and other exterior wall structures, which include stony material. Because of the missing ventilation slot, such a structure is particularly sensitive to damage due to moisture. Then, the wall itself and its insulating layer can be permanently damp, which causes various health hazards. Microbes thriving in moisture, such as e.g. mould fungi, weather the walls, spread in the building and cause symptoms of diseases and a risk of losing health for people on the premises.

When repairing the stony exterior wall structures of such buildings, exterior wall cladding is traditionally pulled down first, thermal insulations are removed and new thermal insulations are installed. After this, the external cladding is rebuilt. Then, it is important that plinths are widened such that a working ventilation slot is provided in the structure. Such repair is sluggish and takes a long time. Furthermore, the costs of repair are high and, even when repaired, the structures do not prevent the weathering of the stony external claddings.

SUMMARY

An object of the invention is to introduce a method for repairing exterior wall structures coated with stone material having got wet and damaged by moisture without pulling down the structures. A further object of the invention is to introduce a method with which the thermal economy of the wall structure can be returned to the original level and the exterior wall structure can also otherwise be made to operate in a way originally intended. An additional object of the invention is to introduce a method using which the health hazard caused by microbes in the structure for indoor air and people on the premises is eliminated.

In the method according to the invention, the transfer of moisture through the external cladding to the wall structure is prevented by treating the external cladding with façade protection, holes are formed in the external cladding and, through the holes, an insulation space behind the external cladding is dried and disinfected with disinfectant. Then, microbes in the insulation space are extinguished by disinfecting. As the external cladding of the wall is treated with façade protection, its structure cannot get wet any more, its normal operation is preserved and no new microbe growth is formed in the structure. Therefore, the health hazard caused by the microbe growth in the structure is eliminated and the health hazards due to the structures for people on the premises are terminated.

Advantages provided with the method are also the significant savings in repair costs and the considerable shortening of repair time, because there is no need to pull down the wall structures. By the method, it is possible to provide a surface, which can be kept clean more easily and cost-effectively than earlier.

Next, the different steps of one repair method in accordance with the invention will be described in more detail. Naturally the steps can be taken in different sequence of events when possible.

1. At the first step, the microbiological condition of thermal insulations in the wall structure is examined by means of laboratory analyses. At the same time, the dampness of the insulation space, the extent of wetness, microbe growths etc. are measured. The drying of the wet façade structure is performed with side-channel or equivalent blowers advantageously by means of preheated air.
2. The stony outer surface of the wall structure is cleaned with a method suitable for the target and loose material is removed.
3. The outer surface is treated to prevent further wetness with a façade protection agent suitable for the purpose, such as e.g. with an MCF façade protection agent. The façade protection agent prevents the absorption of rainwater in the structure, at the same time still allowing water vapour to transfer outside through the structure. The surface protection does not change the appearance of the façade. The façade protection agent is applied on the structure surfaces with a low-pressure sprayer or by rolling.
4. In the wall structure, drying holes are made at a distance from each other and the insulation space is dried by installing a drying tube system in the drying holes. The distance of the holes is such that air and disinfectant are able to spread everywhere. That is, the distance is dependent on the structure, but it can be e.g. 1.2 meters or less. In structures, which include a wooden frame, for instance, the distance of studs is normally 600 mm and, when the holes must be in each gap of the studs, the hole distance is 600 mm. The diameter of the holes and tubes is advantageously about 32 mm. The direction of drying air is determined by the way a structure, such as a roof, is joined in the wall structure. The drying can thus be performed depending on the situation from bottom to top, from top to bottom or sideways.
5. As the drying is almost finished, smoke tracer is run along the drying air within the structure. With the smoke tracer, it is possible to discover how tight the wall structure is e.g. in window joints. At the same time, it is possible to see how well the smoke travels in the insulation space. This information is important before disinfection. With the smoke tracer test, it is also possible to find out if the rooms can be used during disinfection.
6. After the drying has finished, disinfectant suitable for disinfecting insulations damaged by microbes, such as MCF disinfectant, which is provided in aerosol form, is conveyed as smoke-like via the drying tube into the wall structure. The way of applying is determined based on the performed test and it considers, inter alia, construction frames, the tightness of lining, the joining of the wall structure in the roof etc. When required, the flow direction is reversed to ensure that the disinfectant penetrates everywhere in the insulation space. If required, it is also possible to use the aid of suction air. It is recommended that the disinfectant can be conveyed into the structure such that the disinfectant goes pressurised within the structure, whereby it spreads best in the insulation space.
7. The drying tube is removed from the structure. The holes of the tube systems in the structure are repaired and the surface is treated with façade protection suitable for the purpose, such as with MCF façade protection.

The method has been developed for several years. In the study, test walls were built which were made to mould. Next, the studies were transferred to the exterior walls of actual buildings. In the newest study, the insulation space was dried and, after drying, the insulation space was disinfected according to the method. Before and after the study, microbe samples were taken from the insulation space by means of which it was possible to show microbiological changes possibly occurred in the structure.

The results of the samples showed that the badly moulded insulation space of the exterior wall structure could be restored to the normal state. Repairing the mould damage and drying the insulations restored the working condition of the thermal insulation. Treating the external cladding with MCF façade protection prevents the structure from damaging due to slanting rain.

Repairing the building façade with the new method was compared to a conventional method in which the façade cladding is pulled down, the insulations are replaced and the façade is re-built. The costs of the new method are about 15% of the costs of the conventional method.

According to the design manual of the building regulations, the lifetime of a building is assumed 50 years in design. When e.g. the exterior wall structure of a building from the 1980s can be repaired with the more cost-effective repair such that no health hazards occur nor the traditional damage mechanism is possible, an extremely great economic advantage is gained. When more time, e.g. 20 years, is acquired with the repair, the building is reaching the end of its lifetime. At this step, the building in any case requires renovation at some extent. In the renovation to be performed, there is necessarily no need to tamper with the exterior walls, unless e.g. extra thermal insulation is required.

The method according to the invention advantageously employs MCF façade protection, which protects façade faces and materials from moisture and salts as well as prevents the growth of various moulds and microbes in the treated areas. The composition of the product is the following:

- anionic and non-ionic tensides (TEA C6-20 sec. alkyl. sulphonate) less than 5%
- carefully selected polymer dispersants and cationactive guanidine copolymer (PHMG)
- UV-cleaned water The pH of the prepared solution is normal and its specific weight about 1,000 g/liter.

The polymer dispersant (moisture protection agent) used in this product is safe for both materials and the environment as well as for the user. The treated surface retains its natural porosity at the same time as it prevents water from penetrating the structure. The surface is not yet steam-proof, but allows the structure to breath normally. The cationic copolymer guanidine (PHMG) used to prevent the growth of mould and bacteria acts in a physical way, not chemical, and it is thus almost impossible for microbes and bacteria to develop resistance to it. PHMG forms on surfaces and in liquids polymer chains, which puncture and destroy the cell walls of unicellular organisms coming into contact with it.

MCF façade protection is a ready-prepared solution. The product is applied with a brush, a roll or a sprayer into an even layer onto the surface being treated. The intersection of plates and surfaces are also treated carefully. No special protection equipment, except for a respirator mask, is required when applying the product. The recommended use and storage temperature is normal working temperature. The product dries in a few hours in normal moisture and temperature.

MCF façade protection does not contain scents or colourings. The tensides used in the product are easily and quickly biodegradable according to EU regulations. The product contains no alcohols, solvents or other components harmful to respiration or organs. It does not gasify or emit harmful particles. The product does not absorb in the skin or dry mucous membranes.

The invention and its implementation are not limited to the described materials, but it can vary within the scope of the inventive idea presented in the claims.

The invention claimed is:

1. A method for repairing exterior wall structures, the method comprising:

examining a microbiological condition of thermal insulations in the wall structure by means of analyses and measuring a moisture in an insulation space;

cleaning a stony outer surface of the wall structure and removing loose material;

treating the outer surface of the wall structure with a facade protection agent to prevent further wetness;

forming holes in an external cladding of the wall structure, the holes being formed at a distance from each other;

drying the insulation space of the wall structure by installing a drying tube system in drying holes made in the wall;

through the holes, drying the insulation space behind the external cladding and disinfecting with disinfectant;

conveying smoke tracer along with drying air;

when the drying has finished, conveying disinfectant in a smoke form via the drying tube system to the wall structure; and removing the drying tube system from the wall structure, repairing the holes of the tube systems in the wall structure, and treating the outer surface of the wall structure with the facade protection.

2. A method for repairing exterior wall structures according to claim 1, further comprising, when conveying disinfectant to the wall structure, reversing the flow direction to ensure the penetration of the disinfectant everywhere in the insulation space.

3. A method for repairing exterior wall structures according to claim 1, further comprising, when conveying disinfectant to the wall structure, using the aid of suction air.

* * * * *